United States Patent [19]

Ferrante

[11] 3,973,702

[45] Aug. 10, 1976

[54] CONTAINERS FOR PULVERULENT AND GRANULAR PRODUCTS

[76] Inventor: Rafael Ferrante, Catamarca 27, Quilmes, Pcia. Buenos Aires, Argentina

[22] Filed: Jan. 21, 1975

[21] Appl. No.: 542,705

[30] Foreign Application Priority Data

May 30, 1974 Argentina ..... 253992
July 18, 1974 Argentina ..... 254772

[52] U.S. Cl. ..... 222/196.5
[51] Int. Cl.[2] ..... B65G 65/70
[58] Field of Search ..... 259/DIG. 42, 35; 222/196.5, 196.1–196.4

[56] References Cited

UNITED STATES PATENTS

| | | | |
|---|---|---|---|
| 737,267 | 8/1903 | Overbaugh | 222/196.1 |
| 846,256 | 3/1907 | Smith | 222/196.1 |
| 890,634 | 6/1908 | Foote | 222/196.4 |
| 1,102,978 | 7/1914 | Conger | 222/196.4 X |
| 1,970,891 | 8/1934 | King | 222/196.3 |

*Primary Examiner*—Drayton E. Hoffman
*Assistant Examiner*—Norman L. Stack, Jr.
*Attorney, Agent, or Firm*—Fisher, Christen & Sabol

[57] ABSTRACT

A closure member for dispensing container for pulverulent materials includes a displaceable percussion element aperable by shaking the container to assist in clearing the dispensing openings in the closure member.

4 Claims, 7 Drawing Figures

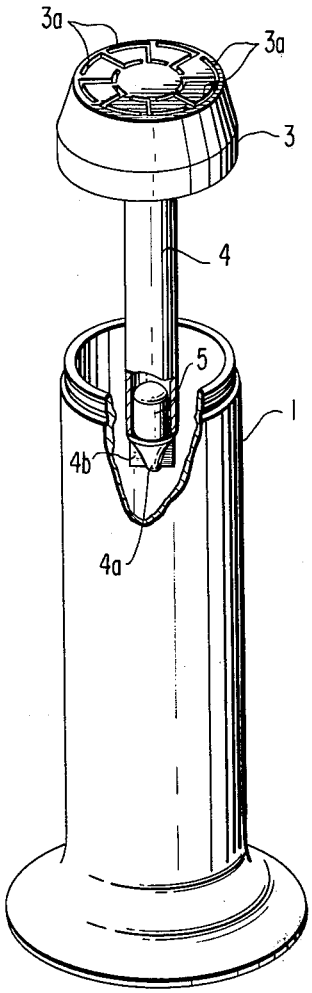
FIG. 1
FIG. 2
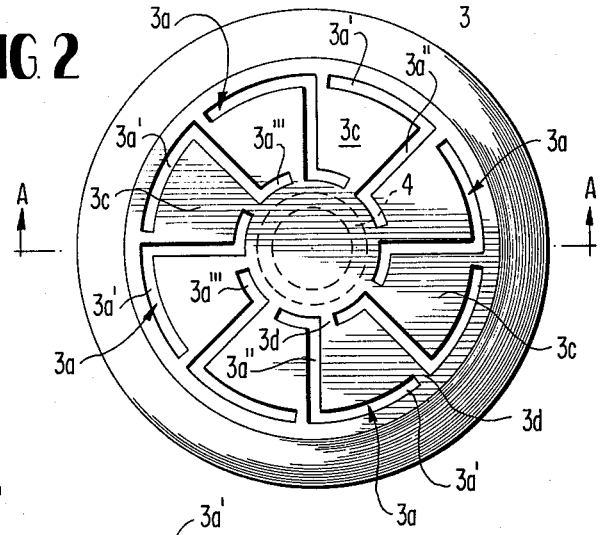
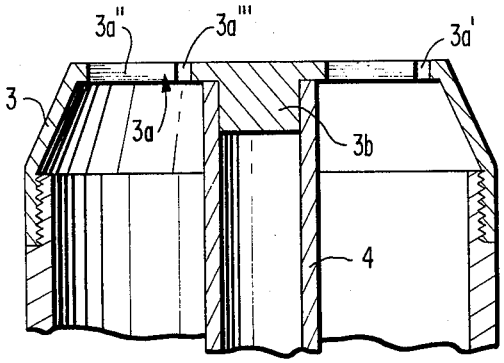
FIG. 4
FIG. 7
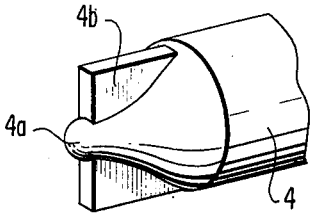
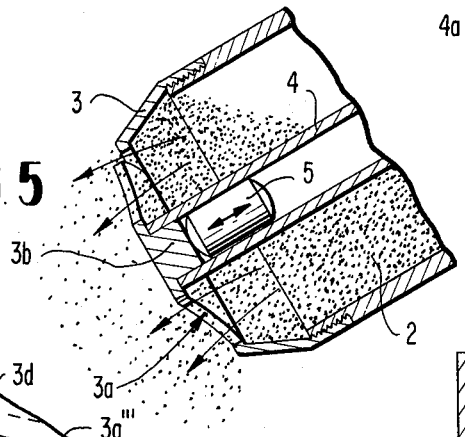
FIG. 5
FIG. 6
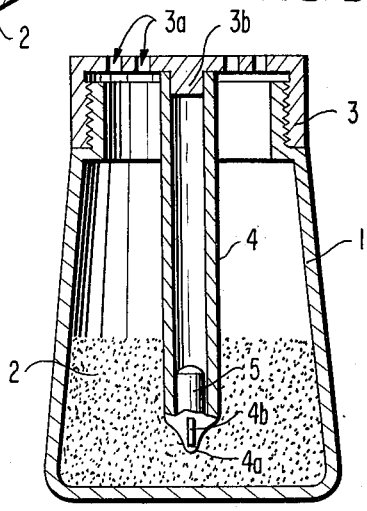
FIG. 3
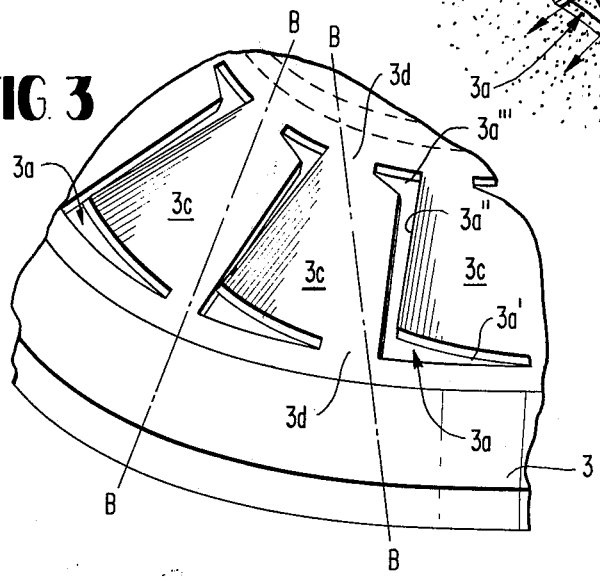

CONTAINERS FOR PULVERULENT AND GRANULAR PRODUCTS

The present invention is related to an improvement in receptacles for pulverulent and granular products such as salt cellars, talc boxes, sugar bowls, pepper-boxes etc. having a novel arrangement of the components, said arrangement offering important advantages in its application and use for the specified purpose.

The problems arising from these types of dispensers are already known, consisting in the plugging of the outlet openings, which is increased when the products have hygroscopic characteristics, which results in the partial or complete lumping or packing of the products, resulting in the complete blocking of the outlet openings of the prior art dispensers.

In addition to the absorption of humidity from the surrounding air, there is the dampness released in the vapor, generated by certain foods on which the granular products is dispensed, which causes the gradual impregnation of the dispensed product, blocking the exits from the dispenser, with the resulting inconvenience consisting in the fact that all of the product must then be discarded, since the water absorbed in a portion of the contents of the dispenser is rapidly transmitted to the entire volume of the contents, with the result that the dispenser is rendered functionally useless, bringing about the spoilage of the contents in addition to the loss thereof.

An object of the present invention is to solve these disadvantages, affording the continual use of the dispenser under whatever conditions it is used without having to refill the dispenser on each occasion when the contents become dampened or requiring periodic cleaning of the outlet openings of the dispenser with consequent removing of the formed lumps and the necessity of eliminating traces of the already hardened product caused by absorption from humid atmospheres.

The dispenser of this invention is comprised of a product container of the usual type which is closed by a perforated cap which, in turn, may or may not be covered by a tightly sealed closure cap of a known type, said invention being that in one form by the container having a percussion device which consists of a tubular receptacle firmly attached to the cap and inside of which a percussion element, or weight, is arranged in a freely shiftable manner, the cap surface having a series of openings which comprise the passageways for the product, the percussion element, or weight, when activated by shaking the container, causing vibration of the cap which effectively causes the granular material, which may have become deposited in said openings, to be loosened therefrom.

In another embodiment of the invention, the openings are angularly formed in the cap, the cap being manufactured from a highly flexible sheet material, said openings forming respective flanges which lie in the plane of the surface of the cap.

When reciprocating movement of the container is effected as is common in the use of dispensers of this type, the solid body of the weight will be displaced in alternate directions by virtue of its inertia, moving towards one or the other end of the tube; thus, when hitting either one of the ends, vibrations are generated which are transmitted to the cap, causing loosening of any material which might have been built up in the openings and, in turn, expediting by means of said vibrations, the passage of material through the openings. The openings may be formed in many diferent configurations, such as round, oval, lineal and so forth.

In a preferred embodiment of the invention, the openings have an angular configuration and the material which forms the cap being highly flexible, the result of vibrations from the percussion element causes the flanges defined by each of said angular openings to fold on respective folding axes for each opening lying in the plane of the cap causing the enlargement of each of the passages with the result that the product accumulated on each opening is loosened allowing an easing of the passage of material from the inside to the outside of the dispenser.

A further advantage of the invention results from the fact that the tubular receptacle for the percussion device, or weight, is tapered at its inner end and provided with a pair of diametrically opposed fins forming a means which facilitates the insertion of the tubular receptacle into the granular material when the cap is applied to the dispenser.

Other objects and advantages of the invention will be apparent to those skilled in the art after reading the following specification.

In order that the present invention may be clearly understood and easily practiced, it has been illustrated, by way of example, and in one of its preferred embodiments, with the accompanying drawings, wherein:

FIG. 1 is a perspective view of one embodiment of the invention.

FIG. 2 is a plan view of the container represented in FIG. 1.

FIG. 3 is a perspective detail of a portion of the container cap, having the flanges of the openings in operative position.

FIG. 4 is a fragmentary cross-section along the line A—A in FIG. 2.

FIG. 5 is a view similar to that of FIG. 4 but showing one of the flanges in operative position.

FIG. 6 is a sectional view of a modification of the dispensing container, and;

FIG. 7 is a perspective detail of the end of the tubular holder for the percussion device.

In all of the above-mentioned figures, the same reference numerals denote the same or corresponding parts.

In a preferred embodiment of the invention, as illustrated in FIG. 1, there is shown a container 1 for the pulverulent or granular material indicated by numeral 2, having a closure cap 3, which is threadedly mounted on one end of the container, said cap being provided with a series of openings *3a* regularly arranged in the surface thereof.

On the inner surface of the closure cap 3, there is an inwardly projecting lug *3b* formed therein, with a cylindrical tube 4 fixed thereto having its other end *4a* closed.

Freely accommodated inside the tube 4, there is a percussion element, or weight, 5 the sectional configuration thereof being proportioned with respect to the tube 4 in order to permit its free displacement within and having an elongated form which may be similar to that illustrated, or of various other configurations such as spherical, or any type of surface of revolution, so that it is kept freely moving inside the tube.

The tube 4 extends in a perpendicular direction with respect to the face of the cap and its position when the cap 3 is mounted on the container, the tube is accommodated inside the container 1 and immersed in the product tube contained therein, the free end of the tube 4*a* being tapered and provided with a pair of fins 4*b* diametrically opposed to each other which make it easy for the user to introduce the tube 4 inside the container 1 when the cap is applied.

The percussion element 5 is a solid body of an optional shape and formed from a high density material, such as steel, lead and so forth, in order to obtain a high value of inertia when it is in use.

In the preferred embodiment shown in FIGS. 1–5, the cap 3 is provided with a series of openings 3*a* for allowing the passage of the product contained in the dispenser and in this preferred embodiment represented by said FIGS. 1–5, the configuration of the openings is substantially in the form of the letter Z, these openings being defined by a series of arcuate portions 3*a'* which correspond to respective consecutive arcs having the same radius, these being joined to another series of straight portions 3*a''* arranged radially to the portions just described, and each of the straight portions is further continued by another series of arcuate portions 3*a'''* having respective arcs of a shorter radius than the arcuate portions 3*a'* and concentric therewith.

As can be seen in FIGS. 2 and 3, the two sides of each of the flanges 3*c* are defined by adjacent pairs of radial openings 3*a''*, one end of each flange being defined by the arcuate portion 3*a'* joined to one of the radial openings, while the other end of each flange is defined by the arcuate portion 3*a'''* joined to the other of the pair of radial openings 3*a''*, with the result that each of the flanges 3*c* is connected with the remainder of the wall of the cap 3 by oppositely disposed portions 3*d* which provides a folding axis B—B for each flange, as can be seen in FIG. 3. Thus, a series of folding flanges 3*c* are symmetrically arranged circumferentially in the cap 3.

The operation and use of the present improved dispenser illustrated in FIGS. 1 through 5, is effected in a very simple way, in accordance with the particularized description below.

Once the product 2 is placed into the container 1, the cap 3, which in this particular case is threaded, is positioned accordingly; however, it is optionally adapted to be mounted in any other way which integrally links it with the container 1.

To make the positioning of said cap 3 easy, without a jamming thereof by the friction which is caused by the product 2 at the end of the tube 4, the rounded configuration which shows its free end 4*a* has been provided, and in order to effect its penetration with little effort into the product mass 2, there is provided a pair of fins 4*b* diametrally opposed one to the other.

This improved dispenser, as it is customary in its use, is operatively reversed, confronting the face exposed to the cap 3, against the surface to be dosified with the product, imparting to the dispenser a suddden reciprocating movement in an axial direction along its longitudinal central axis; in this manner, the body 5, by its inertia, will be suddenly displaced in the inside of the tube 4, hitting against the closed end 4*a*, with the lug 3*b* producing vibrations which are transmitted to the cap throughout, the openings thereof being freed of any accumulation of the product 2 which may prevent the passage of more of it, said vibrations easing the passage of component grains or particles of same through said openings, and preventing its accumulation on the contours thereof.

It can be noted that, as the cap 3 is hit, the fins 3*c*, the material of said cap being very flexible, are pivoted on the respective axes B—B, as illustrated in FIGS. 3 and 5, enlarging each opening, easing the passage of the product and loosening the eventual accumulations thereof. This pivotal action results from the fact that the area of each flange disposed on one side (the left side of axis B—B in FIG. 3) is greater than the area of the flange disposed on the opposite side of the axis.

In FIG. 6 there is illustrated a saltcellar with a perforated cap provided with the proposed improvements and the percussion device applied to the cap, which tends to prevent the building up of the product within the cap perforations.

The invention, as in the above embodiment is self-evident and does not require any further explanation for those expert in the art.

Obviously, several modifications can be introduced in construction and detail, without departing from the scope of the present invention, clearly defined in the following claims.

I claim:

1. In dispensing containers for pulverulent material the combination comprising a cap having a closure wall of flexible material provided with a plurality of openings defined by a series of flexible fins, said fins being attached at their outer ends to the periphery of the cap by narrow portions which allow the fins to flex and being joined at their inner ends to a common central area of the flexible closure wall by other narrow portions which allow the fins to flex, a tubular element attached at one end to said common central area and extending downwardly into the container, and a percussion element freely, movably contained within the tubular element, whereby when said dispenser is reciprocally shaken, said fins are flexed as a result of reciprocation of said percussion element to loosen material accumulated on the closure surface.

2. The invention defined in claim 1, wherein said fins are defined by a series of symmetrically arranged, circumferentially disposed openings having a generally Z-shaped configuration defined by a pair of radially spaced, concentric, arcuate openings joined to each other by a radially extending elongated opening.

3. The invention defined in claim 2, wherein the exterior of one end of the tubular element is tapered and is provided with a pair of fins for facilitating entry of the tubular element into material contained in the dispenser.

4. The invention defined in claim 2, wherein said percussion element is formed of a high density material.

Freely accommodated inside the tube 4, there is a percussion element, or weight, 5 the sectional configuration thereof being proportioned with respect to the tube 4 in order to permit its free displacement within and having an elongated form which may be similar to that illustrated, or of various other configurations such as spherical, or any type of surface of revolution, so that it is kept freely moving inside the tube.

* * * * *